US011584625B2

(12) United States Patent
Schulz et al.

(10) Patent No.: US 11,584,625 B2
(45) Date of Patent: Feb. 21, 2023

(54) TRUNNION BLOCK ASSEMBLY

(71) Applicant: Snap-on Incorporated, Kenosha, WI (US)

(72) Inventors: Benjamin T. Schulz, Racine, WI (US); Jonathan I. Andersen, Mount Pleasant, WI (US); James T. Rettler, Kenosha, WI (US)

(73) Assignee: Snap-on Incorporated, Kenosha, WI (US)

( * ) Notice: Subject to any disclaimer, the term of this patent is extended or adjusted under 35 U.S.C. 154(b) by 263 days.

(21) Appl. No.: 16/429,426

(22) Filed: Jun. 3, 2019

(65) Prior Publication Data

US 2020/0377349 A1 Dec. 3, 2020

(51) Int. Cl.
*B66F 5/04* (2006.01)
*F15B 15/06* (2006.01)

(52) U.S. Cl.
CPC ..... *B66F 5/04* (2013.01); *F15B 15/06* (2013.01)

(58) Field of Classification Search
CPC combination set(s) only.
See application file for complete search history.

(56) References Cited

U.S. PATENT DOCUMENTS

| | | | | |
|---|---|---|---|---|
| 2,231,047 | A | 2/1941 | Ziska | |
| 2,470,105 | A | 2/1946 | Murphy | |
| 3,154,290 | A | 10/1964 | Johnson | |
| 3,907,252 | A | 9/1975 | Gaarder | |
| 3,958,793 | A | 5/1976 | Garate | |
| 4,018,421 | A | 4/1977 | Tailman | |
| 4,131,263 | A | 12/1978 | John | |
| 4,241,899 | A | 12/1980 | Kaneko | |
| 4,473,213 | A | 9/1984 | Decker | |
| 4,742,991 | A * | 5/1988 | Hung | B66F 5/04 254/8 B |
| 5,709,520 | A * | 1/1998 | Pish | B60S 13/00 254/7 B |
| 6,634,843 | B1 * | 10/2003 | Tarnow | F16B 21/12 403/155 |
| 7,137,615 | B2 * | 11/2006 | Ray, Jr. | B66F 5/04 254/89 H |
| 2005/0218384 | A1 | 10/2005 | Hernandez et al. | |

(Continued)

FOREIGN PATENT DOCUMENTS

| | | | |
|---|---|---|---|
| CN | 202007102 | U | 10/2011 |
| CN | 102602842 | B | 11/2013 |
| WO | 2013035063 | A1 | 3/2013 |

OTHER PUBLICATIONS

Chinese Office Action for Application No. 11020000180 dated Jan. 5, 2021, 7 pages.

(Continued)

*Primary Examiner* — Lee D Wilson
(74) *Attorney, Agent, or Firm* — Seyfarth Shaw LLP

(57) ABSTRACT

The present invention relates broadly to a floor jack and a multi-component trunnion assembly that transfers motion of a power unit to the lifting arm of the jack. The end block may include one or more trunnions that are coupled to the block. The trunnions may engage and be coupled to one or more connection plates coupled to the lifting arm of the jack. A hydraulic power unit, including at least one piston may be coupled to the trunnion block for lifting the lifting arm of the jack.

16 Claims, 4 Drawing Sheets

(56) References Cited

U.S. PATENT DOCUMENTS

| | | | | |
|---|---|---|---|---|
| 2006/0278858 | A1 | 12/2006 | Brocchini, Jr. | |
| 2017/0158473 | A1 | 6/2017 | Wu | |
| 2020/0377349 | A1* | 12/2020 | Schulz | B66F 5/04 |

OTHER PUBLICATIONS

Examination Report for Application No. 2020201972 dated Jan. 15, 2021, 9 pages.
Search Report for Application No. GB2004575.3 dated Sep. 3, 2020, 4 pages.
Australian Examination Report No. 2 for corresponding AU Application No. 2020201972, dated Sep. 17, 2021, 3 pages.
Canadian Office Action for corresponding CA Application No. 3,081,888, dated Jul. 7, 2021, 6 pages.
Chinese Office Action for corresponding CN Application No. 202010490912.7, dated Jul. 30, 2021, 7 pages.
Australian Examination Report No. 3 for Application No. 2020201972, dated Nov. 15, 2021, 3 pages.

* cited by examiner

TRUNNION BLOCK ASSEMBLY

TECHNICAL FIELD OF THE INVENTION

The present invention relates generally to jacks. More particularly, the present invention relates to a multi-part trunnion block for a jack mechanism.

BACKGROUND OF THE INVENTION

Floor jacks are used in repair shops to lift a vehicle from the ground. An operator positions the floor jack underneath a lift point and raises the vehicle at that point. Floor jacks can be powered by manual or automated means, and have become important to the automotive repair industry.

Shop floor jacks are required to withstand significant amounts of weight, such as that of a vehicle. In order to provide the strength and stability to support such weights, the internal components of the jack must be sturdy and capable of withstanding great forces, in multiple directions, during actuation of the lifting and releasing mechanism of the jack. Traditional floor jacks use a trunnion block, or end block, to transfer power and motion from a power unit (i.e., piston(s) and lift mechanisms) to the lifting arm of the jack. Traditional end blocks are unitary bodies with flanges or pins extending from the side of the end block. These end pins and the end block are formed as a unitary body, which creates a point of weakness in the structural integrity of the block, particularly when a large force or other stress is applied to the saddle or the lifting mechanism of the jack.

SUMMARY OF THE INVENTION

The present invention relates broadly to a floor jack and a multi-component trunnion block assembly that transfers lateral power and motion of a power unit of the jack to the lifting arm of the jack. According to one embodiment, the present invention broadly comprises a trunnion block assembly for transferring motion from a jack power unit to a lifting arm is disclosed. The assembly may include a block with first and second trunnion recesses and a piston recess. The piston recess may be sized and shaped to receive at least a portion of a piston. First and second trunnions may be sized and shaped to respectively engage the first and second trunnion recesses.

According to another embodiment, the present invention broadly comprises a trunnion block assembly for a floor jack including a frame, a lifting arm, and a handle pivotally coupled to the frame. The trunnion bock assembly may include a block defining first and second trunnion recesses and a piston recess. A first trunnion may be sized and shaped to engage with the first trunnion recess and a second trunnion may be sized and shaped to engage with the second trunnion recess. A hydraulic power unit may include a piston sized and be shaped to engage the piston recess of the block. A first and second connection plate may be sized and shaped to couple the first and second trunnions to the lifting arm.

According to another embodiment, the present invention broadly comprises a floor jack that includes a frame, a lifting arm pivotally coupled to the frame, a hydraulic power unit including a piston, and a handle pivotally coupled to the hydraulic power unit. A trunnion block assembly may be coupled to the hydraulic power unit and the lifting arm. The trunnion block assembly may include a block defining first and second trunnion recesses and a piston recess. The piston recess may be sized and shaped to receive at least a portion of a piston. First and second trunnions may be sized and shaped to respectively engage the first and second trunnion recesses. First and second connection plates may be coupled to the first and second trunnions and the lifting arm.

BRIEF DESCRIPTION OF THE DRAWINGS

For the purpose of facilitating an understanding of the subject matter sought to be protected, there is illustrated in the accompanying drawing embodiments thereof, from an inspection of which, when considered in connection with the following description, the subject matter sought to be protected, its construction and operation, and many of its advantages, should be readily understood and appreciated.

DETAILED DESCRIPTION OF THE EMBODIMENTS

Figure 1:
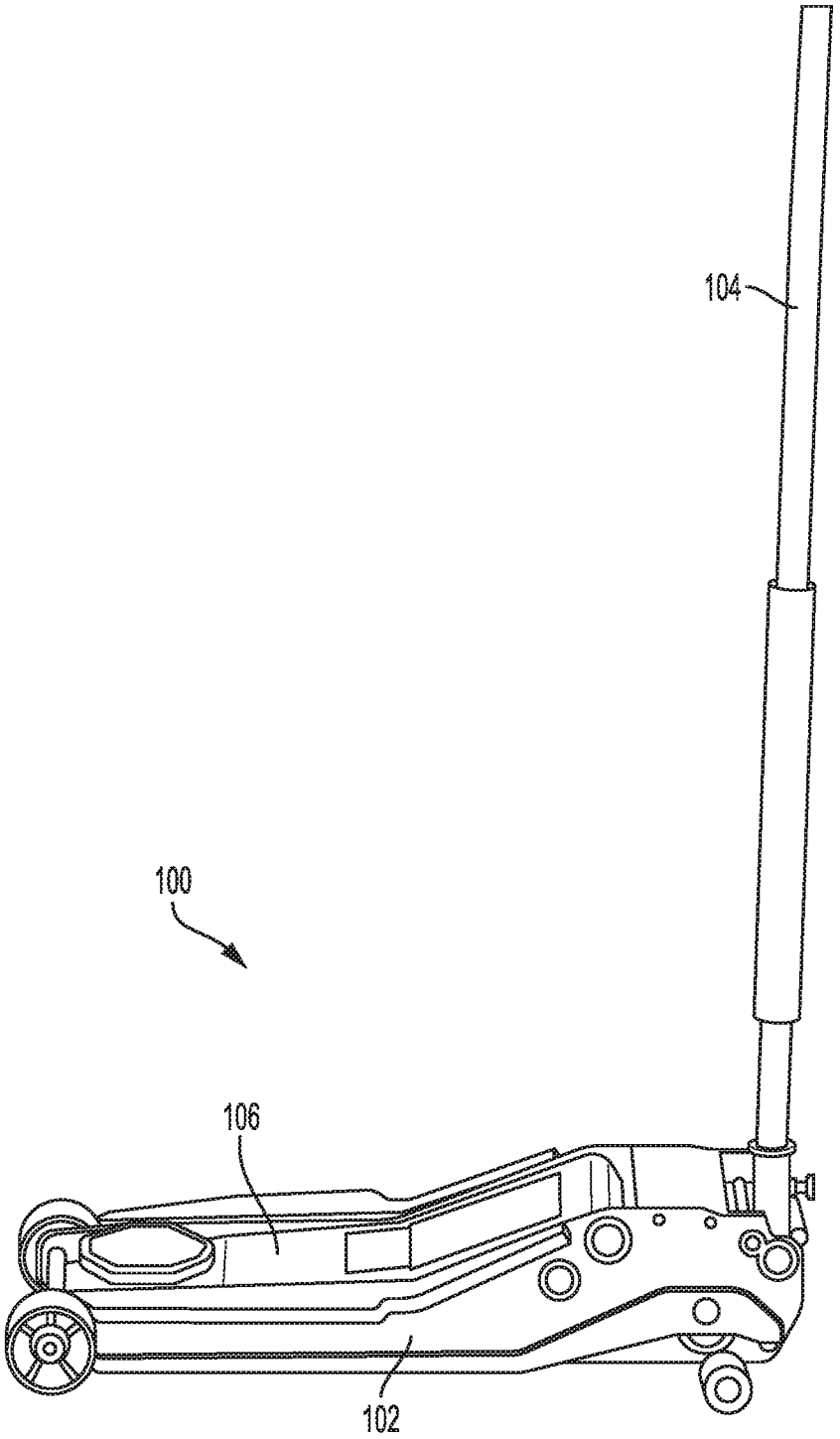
FIG. 1 is an assembled view of a typical floor jack incorporating an embodiment of the present invention.

While the present invention is susceptible of embodiments in many different forms, there is shown in the drawings, and will herein be described in detail, embodiments, including a preferred embodiment, of the invention with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

The present invention broadly relates to a floor jack and a multi-component trunnion block coupling a power unit to a lifting arm of the jack. In an embodiment, the multi-component trunnion assembly provides additional strength to the trunnion block to withstand forces applied to the jack from the lifting mechanism and the object being lifted. The assembly may include a block with first and second trunnion recess and a piston recess. The piston recess may be sized and shaped to receive at least a portion of a piston. First and second trunnions may be sized and shaped to respectively engage the first and second trunnion recesses.

Figure 2:
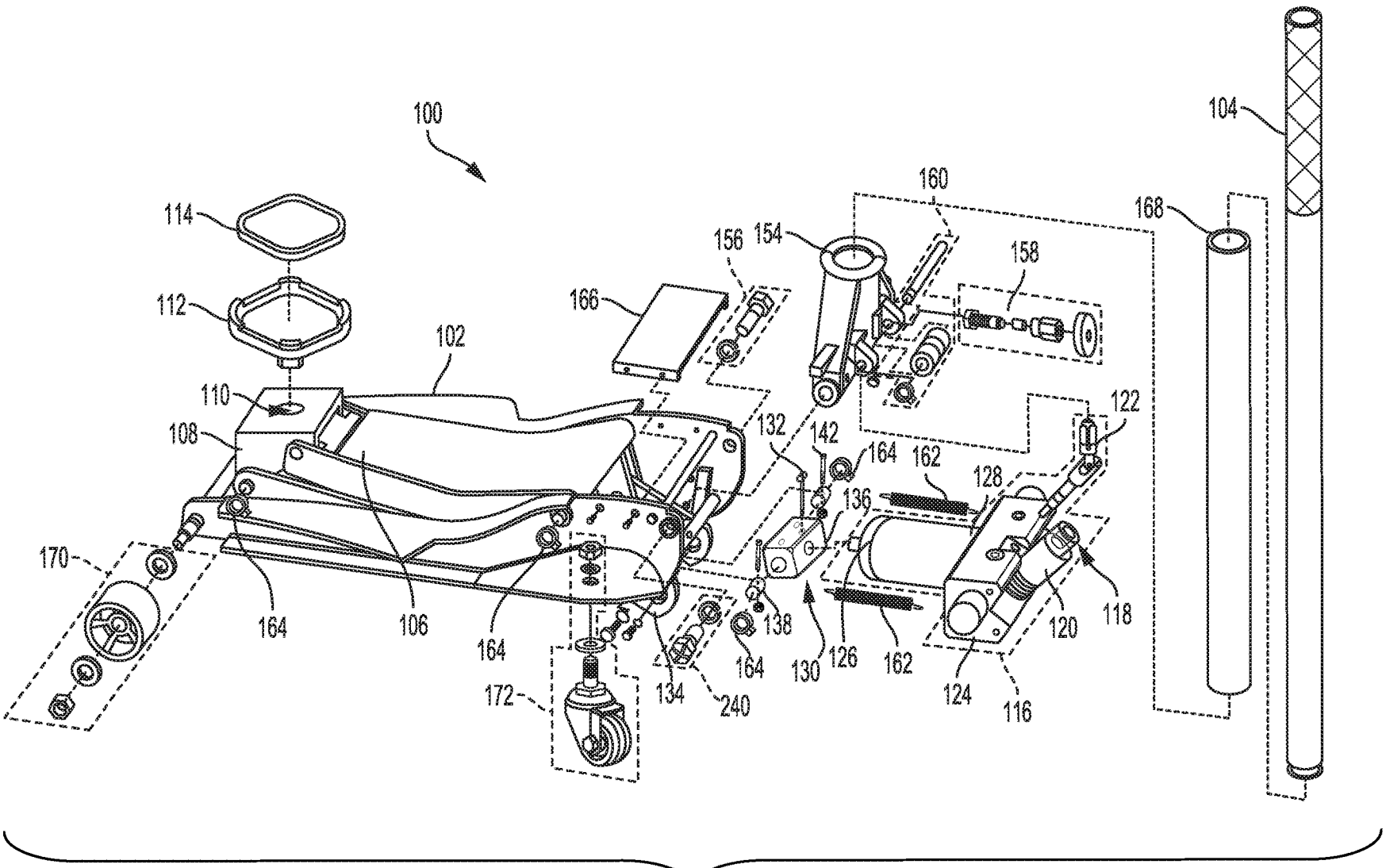
FIG. 2 is a disassembled, exploded perspective view of the jack of FIG. 1.

Referring to FIGS. 1 and 2, a floor jack 100 includes a frame 102, a handle 104, and a lifting arm 106. The handle 104 is operably coupled to the lifting arm 106, which is coupled to and movable relative to the frame 102 in response to motion of the handle 104. A saddle base 108 is coupled to the lifting arm 106 and moves with the lifting arm 106 in response to motion of the handle 104, allowing the saddle base 108 to raise a vehicle. The saddle base 108 may include an opening 110 that receives a stalk or other connector extending from an underside of a saddle 112. A pad 114 may be included on a vehicle-facing surface of the saddle 112 to help avoid marring or damaging the vehicle. The saddle 112 and pad 114 may be changeable to accommodate different types of lift points, depending upon the vehicle. It will be appreciated that while the present invention is broadly discussed as being used for lifting a vehicle, this is for exemplification purposes only, as the present invention can be used to lift or otherwise move any object that can be lifted with floor jacks.

The hydraulics of the jack 100 are part of a power unit 116. The power unit 116 may include a drive piston 118 slidably mounted in a fluid cylinder 120 to compress/pump fluid within the fluid cylinder 120, and a release valve mechanism 122. A valve block 124 of the power unit 116 may be coupled to the frame 102, and a lift piston 126 that is slidable within a lift-piston assembly 128 of the power unit 116 may be coupled to a trunnion block assembly 130, which is coupled to the lift piston 126 (such as by a cotter pin 132).

Figure 3:
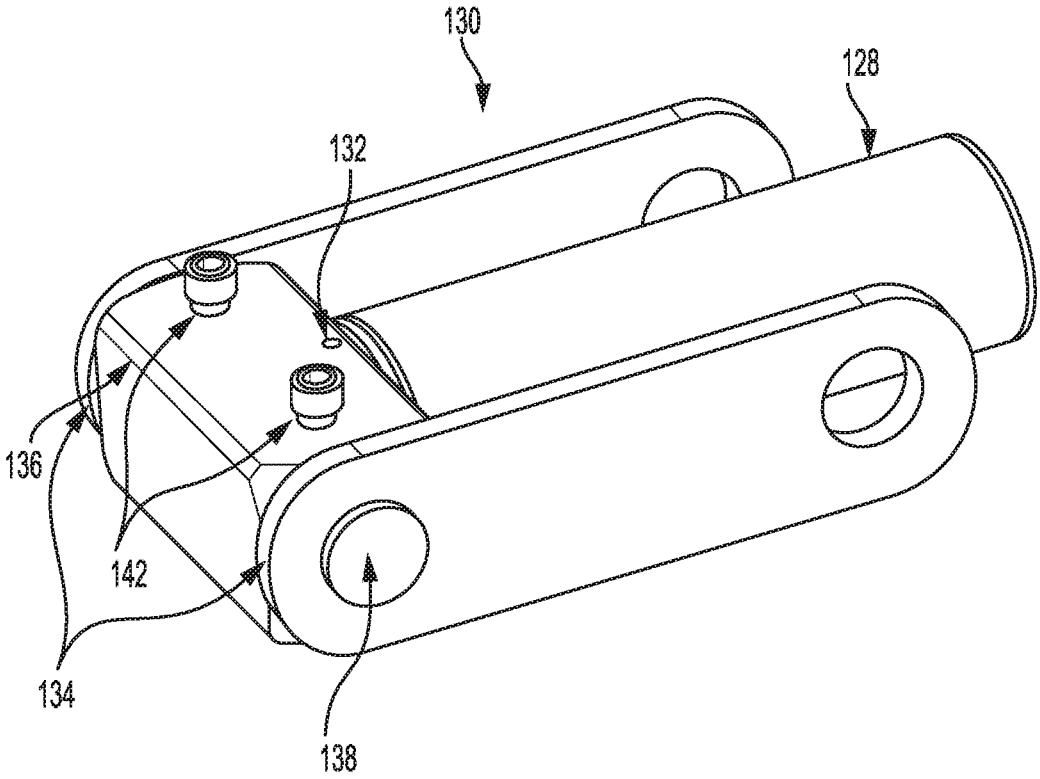
FIG. 3 is a perspective view of an end-block assembly of an embodiment of the present invention.
Figure 4:
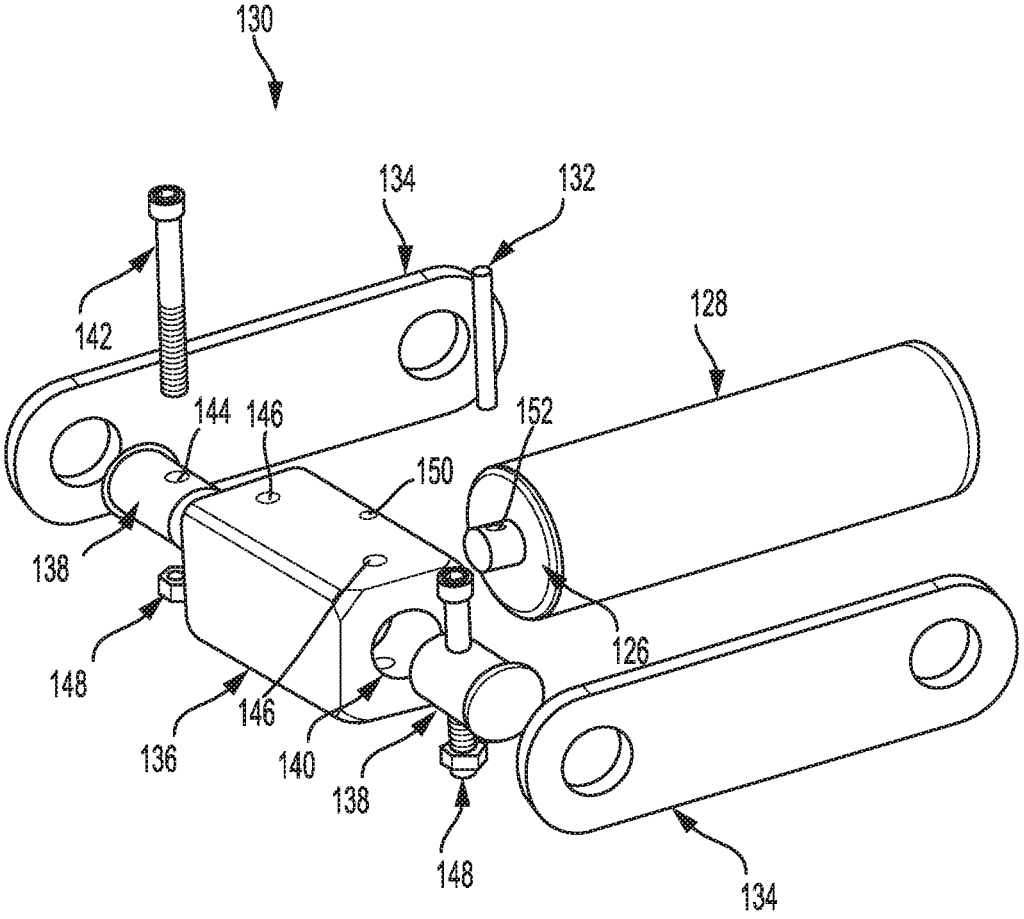
FIG. 4 is an exploded view of the end block assembly of FIG. 3.

FIGS. 3 and 4 depict a trunnion block assembly 130 according to an embodiment of the present invention. FIG. 3 is a perspective view of an trunnion block assembly 130 and FIG. 4 depicts an exploded view. In an embodiment, the trunnion block assembly 130 is coupled to the lifting arm 106 through connection plates 134. The trunnion block assembly 130 may include a block 136 and one or more trunnions 138 sized and shaped to fit corresponding trunnion recesses 140 defined in the side walls of the block 136. Each trunnion 138 may be coupled to the block 136 by a fastener 142 passing through the block 136 and fastener recesses 144 defined in the trunnions 138. Corresponding block fastener recess 146 may be defined in a top and bottom surface of the block 136.

Each trunnion 138 may also include a flanged end to hold the corresponding connection plate 134 on the trunnion 138. To assemble the trunnion block assembly 130, the corresponding connection plate 134 may be slid onto the corresponding trunnion 138. The trunnions 138 may be inserted into the trunnion recesses 140 such that the trunnion fastener recess 144 aligns with the block fastener recesses 146, and the connection plate 134 is disposed between the flanged end of the trunnion 138 and the trunnion fastener recess 144. The fastener 142 may be inserted through the block fastener recess 146 and the trunnion fastener recesses 144. The fastener 142 may be, for example, a threaded bolt, cotter pin, shear pin, or the like. The fastener 142 may be coupled to the assembly using a nut 148, for example a threaded bolt fastener, or a spring clip or retainer pin in the case of a cotter pin fastener. One end of the piston assembly 128 may be disposed in a piston recess (shown in FIG. 2) defined in the block 136. A cotter pin 132 or the like may couple the piston to the block 136 through a pin recess 150 and a piston coupling recess 152 of the piston assembly 128.

Traditional trunnion blocks are formed as a single body including the main block and the trunnions, which form the connection points with the lifting arm of the jack. Under force or pressure, from either the weight supported by the jack saddle or force applied to the trunnion block from the power unit, the trunnions undergo significant force from the connection plates and the power unit. As a unitary body, traditional trunnions protruding from the block may shear, fracture, or otherwise fail due to the force applied to the trunnions by the connection plates as the piston forces the movement of the block. The trunnion block assembly 130 described herein provides a structural advantage over a traditional trunnion block due to the arrangement of the multiple components of the assembly. The separate trunnions 138, coupled to the block 136 by the fasteners 142, provide stronger support for transferring the lateral or other directional forces or pressure from a head of the piston 126 pressing against the block 136 to the connection plates 134 coupled to the lifting arm 106. As such the trunnion block assembly 130 and the floor jack in general are stronger and less likely to fail under significant force or pressure.

While the trunnions 138 described herein depict the trunnions with defined recesses for receiving a fastener to couple the trunnion to the block, it will be appreciated that other modes for coupling the trunnions 138 to the block 136 are within the scope of the present invention. For example, the trunnions 138 may include a threaded surface about the outer circumference of the trunnion. In such a configuration, the trunnion recesses 140 of the block 136 may include a threaded inner surface for receiving the threaded portion of the trunnion 138.

Returning to FIG. 2, in operation of the jack, force or pressure on the hydraulic fluid generated in the fluid cylinder 120 is transferred by the valve block 124 into the lift-piston assembly 128, to push against the lift piston 126 in the piston assembly 128. This generates a unidirectional force as the lift piston 126 pushes against the block 136. The block 136 transfers the force from the lift piston 126 to the lifting arm 106, causing the saddle base 108 to rise.

A handle yoke 154 is pivotably coupled to the frame 102 by pivot bolts 156. The handle 104 is inserted into and coupled to the handle yoke 154 via a retaining pin 158. A yolk pump roller assembly 160 is coupled to the handle yolk 154, and disposed or positioned so that when the handle 104 is pushed or pumped, a roller of the roller assembly 160 compresses the drive piston 118, creating hydraulic force or pressure within the fluid cylinder 120. A spring (not illustrated) may be compressively mounted around the periphery of the drive piston 118, or enclosed within the fluid cylinder 120, to cause the drive piston 118 to rebound from the fluid cylinder 120 for the upstroke during pumping.

Depending on how the release valve mechanism 122 and the handle yoke 154 are configured, moving the handle 104 forwardly or twisting the handle 104 pulls on the release valve mechanism 122, causing the release valve mechanism 122 to release the hydraulic force or pressure within the power unit 116. Springs 162 may be disposed between the block 136 and the frame 102 to compress the head of the lift piston 126 back into the piston assembly 128, creating reverse force or pressure on the hydraulic fluid in the piston assembly 128 so that the saddle base 108 descends when the release valve mechanism 122 is opened, even if there is no load on the jack 100.

Various components of the jack, such as the connection plates 134, may be coupled in place, among other ways, for example, with retaining rings 164. Once the jack 100 is assembled, a cover plate 166 may be coupled to the frame 102 to shield the internal components. An end of the handle 104 may be knurled or textured to provide a grip surface. As an additional grip surface, a handle pad 168 (e.g., foam) may be disposed over the handle 104. The jack 100 may have wheels for ease-of mobility. FIG. 2 illustrates one-of-two front wheel assemblies 170, and one-of-two rear wheel assemblies 172, mounted to the frame 102. However, it should be appreciated that the wheels may be replaced by a singular roller.

From the foregoing, it can be seen that there has been described an improved jack with a trunnion bock assembly that includes one or more trunnions coupled to a block such that upon actuation of a power unit, including a piston, the trunnion block assembly displaces connection plates coupled to a lifting arm of the jack. The multi-component trunnion block assembly provides a structural advantage over a unitary body trunnion block with the trunnions formed as part of the body.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object. As used herein, the term "a" or "one" may include one or more items unless specifically stated otherwise.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A trunnion block assembly for transferring motion from a piston of a jack power unit to a lifting arm, the assembly comprising:

a block including first and second trunnion recesses and a piston recess, the piston recess is adapted to receive at least a portion of the piston, and the block is adapted to be moved by the piston to transfer a force from the piston to the lifting arm to cause the lifting arm to raise; and first and second trunnions adapted to respectively engage the first and second trunnion recesses, and adapted to couple the block to the lifting arm.

2. The trunnion block assembly of claim 1, wherein each of the first and second trunnions includes a fastener recess, and the first and second trunnions are coupled to the block by respective fasteners passing through the block and the respective fastener recesses.

3. The trunnion block assembly of claim 2, wherein the fastener is a threaded bolt.

4. The trunnion block assembly of claim 2, wherein the fastener is a cotter pin.

5. The trunnion block assembly of claim 4, wherein the cotter pin is coupled to the block by a retaining pin.

6. The trunnion block assembly of claim 1, wherein the first and second trunnions include threaded surfaces, and the first and second trunnion recesses define threaded interior surfaces adapted to respectively receive the threaded surface of the first and second trunnions, respectively.

7. The trunnion block assembly of claim 1, wherein the piston includes a hydraulic cylinder.

8. A trunnion block assembly for a floor jack including a frame, a lifting arm, and a handle pivotally coupled to the frame, the trunnion block assembly comprising:

a block defining first and second trunnion recesses and a piston recess;

a first trunnion adapted to engage the first trunnion recess, a second trunnion adapted to engage the second trunnion recess;

a hydraulic power unit including a piston adapted to engage the piston recess of the block, wherein the block is adapted to be moved by the piston to transfer a force from the piston to the lifting arm to cause the lifting arm to raise; and first and second connection plates adapted to respectively couple the first and second trunnions to the lifting arm.

9. The trunnion block assembly of claim 8, wherein each of the first and second trunnions includes a fastener recess, and the first and second trunnions are coupled to the block by fasteners passing through the block and the respective fastener recesses.

10. The trunnion block assembly of claim 9, wherein the fastener is a threaded bolt.

11. The trunnion block assembly of claim 9, wherein the fastener is a cotter pin.

12. The trunnion block assembly of claim 11, wherein the cotter pin is coupled to the block by a retaining pin.

13. The trunnion block assembly of claim 8, wherein the first and second trunnions include respective threaded surfaces, and the first and second trunnion recesses define respective threaded interior surfaces adapted to respectively receive the threaded surface of the first and second trunnions.

14. The trunnion block assembly of claim 8, wherein the piston includes a hydraulic cylinder.

15. A floor jack comprising:

a frame;

a lifting arm pivotally coupled to the frame;

a hydraulic power unit including a piston;

a handle pivotally coupled to the hydraulic power unit; and a trunnion assembly coupled to the hydraulic power unit and the lifting arm, the trunnion assembly includes:

a block including first and a second trunnion recesses, and a piston recess adapted to receive at least a portion of the piston, wherein the block is adapted to be moved by the piston to transfer a force from the piston to the lifting arm to cause the lifting arm to raise;

first and second trunnions adapted to respectively engage the first and second trunnion recesses; and first and second connection plates respectively coupled to the first and second trunnions and the lifting arm.

16. The floor jack of claim 15, further comprising a spring disposed between the block and the frame, and adapted to provide a compressive force to the piston in a direction towards the hydraulic power unit.

* * * * *